US008137743B2

(12) United States Patent
Fuchita

(10) Patent No.: US 8,137,743 B2
(45) Date of Patent: Mar. 20, 2012

(54) METHOD FOR FORMING ZIRCONIA FILM

(75) Inventor: Eiji Fuchita, Narita (JP)

(73) Assignee: Fuchita Nanotechnology Ltd., Chiba (JP)

( * ) Notice: Subject to any disclaimer, the term of this patent is extended or adjusted under 35 U.S.C. 154(b) by 0 days.

(21) Appl. No.: 13/057,514

(22) PCT Filed: Jan. 21, 2010

(86) PCT No.: PCT/JP2010/000325

§ 371 (c)(1),
(2), (4) Date: Feb. 15, 2011

(87) PCT Pub. No.: WO2010/128572

PCT Pub. Date: Nov. 11, 2010

(65) Prior Publication Data

US 2011/0305828 A1 Dec. 15, 2011

(30) Foreign Application Priority Data

| | | |
|---|---|---|
| May 8, 2009 | (JP) | 2009-113317 |
| Oct. 16, 2009 | (JP) | 2009-239654 |
| Oct. 16, 2009 | (JP) | 2009-239665 |
| Dec. 8, 2009 | (JP) | 2009-278601 |
| Jan. 19, 2010 | (JP) | 2010-009016 |

(51) Int. Cl.
*B05D 1/12* (2006.01)

(52) U.S. Cl. ..... 427/190; 427/201; 427/427

(58) Field of Classification Search ..... 427/190, 427/201, 427

See application file for complete search history.

(56) References Cited

U.S. PATENT DOCUMENTS

| | | | | |
|---|---|---|---|---|
| 4,999,182 | A * | 3/1991 | Baumard et al. | 423/608 |
| 5,620,637 | A * | 4/1997 | Kaga et al. | 264/681 |
| 5,716,565 | A * | 2/1998 | Stangle et al. | 264/681 |

FOREIGN PATENT DOCUMENTS

| | | | |
|---|---|---|---|
| JP | 2001-152360 | A | 6/2001 |
| JP | 2003-073855 | A | 3/2003 |
| JP | 2003-073855 | * | 12/2003 |
| JP | 2006-169606 | A2 | 6/2006 |
| JP | 2007-023379 | A | 2/2007 |
| JP | 2007-146266 | A | 6/2007 |
| JP | 2008-081175 | A | 4/2008 |
| JP | 2008-137860 | A | 6/2008 |
| JP | 2008-081775 | * | 10/2008 |

* cited by examiner

*Primary Examiner* — Frederick Parker
(74) *Attorney, Agent, or Firm* — Harness, Dickey & Pierce, PLC

(57) ABSTRACT

[Object] To provide a method for forming a zirconia film, which is capable of obtaining favorable film quality by an aerosol gas deposition method.

[Solving Means] The method for forming a zirconia film by an aerosol gas deposition method, the method including: placing zirconia fine particles P having a mean particle diameter of 0.7 μm or more and 11 μm or less and a specific surface area of 1 $m^2/g$ or more and 7 $m^2/g$ or less in a closed container 2; generating aerosol A of the zirconia fine particles P by introduction of a gas into the closed container 2; conveying the aerosol A through a transfer pipe 6 connected to the closed container 2 into a deposition chamber 3 kept at a pressure lower than that of the closed container 2; and depositing the zirconia fine particles P on a substrate S placed in the deposition chamber 3. It is possible to form a zirconia thin film that is dense and highly adhesive to the substrate by zirconia fine particles satisfying the above-mentioned conditions.

10 Claims, 7 Drawing Sheets

| Example 1 | Average particle diameter of raw material (μm) | Specific surface area ($m^2/g$) | Particulate amount (g) | Nozzle opening (mm×mm) | Gas flow rate (L/min) | Differential pressure (kPa) | Rate for driving substrate (mm/s) | Lamination number (pass) | Film thickness (μm) |
|---|---|---|---|---|---|---|---|---|---|
| 1-1 | 1.9 | 3.1 | 80 | 30×0.3 | 12 | 34 | 1 | 200 | 16 |
| 1-2 | 4.6 | 1.7 | 100 | 30×0.3 | 14 | 38 | 2 | 200 | 21 |
| 1-3 | 4.6 | 1.7 | 100 | 30×0.3 | 12 | 34 | 1 | 50 | 12 |
| 1-4 | 2.0 | 3.7 | 80 | 30×0.3 | 12 | 34 | 1 | 50 | 16 |
| Comparative Example 1 | | | | | | | | | |
| 1-1 | 3.6 | 12.0 | 40 | 30×0.3 | 12 | 36 | 1 | 50 | Green compact |
| 1-2 | 56.9 | 4.3 | 80 | 30×0.3 | 10 | 32 | 1 | 50 | Film separation |
| 1-3 | 13.7 | 0.4 | 80 | 30×0.3 | 6 | 26 | 1 | 50 | None |
| 1-4 | 0.5 | 7.2 | 60 | 30×0.3 | 12 | 36 | 1 | 50 | Green compact |
| 1-5 | 1.8 | 5.4 | 80 | 30×0.3 | 12 | 34 | 1 | 50 | Green compact |

FIG.3

| Example 2 | Average particle diameter of raw material (μm) | Specific surface area ($m^2/g$) | Particulate amount (g) | Nozzle opening (mm×mm) | Gas flow rate (L/min) | Differential pressure (kPa) | Rate for driving substrate (mm/s) | Lamination number (pass) | Film thickness (μm) |
|---|---|---|---|---|---|---|---|---|---|
| 2-1 | 2.9 | 2.7 | 80 | 30×0.3 | 14 | 38 | 1 | 50 | 8 |
| 2-2 | 7.4 | 1.6 | 80 | 30×0.3 | 10 | 32 | 1 | 50 | 14 |
| 2-3 | 10.2 | 1.5 | 80 | 30×0.3 | 8 | 28 | 1 | 50 | 30 |
| 2-4 | 10.2 | 1.5 | 80 | 30×0.3 | 4 | 22 | 1 | 50 | 7 |
| 2-5 | 0.73 | 6.1 | 80 | 30×0.3 | 16 | 42 | 1 | 50 | 28 |
| 2-6 | 1.12 | 4.7 | 80 | 30×0.3 | 12 | 36 | 1 | 50 | 6 |
| Comparative Example 2 | | | | | | | | | |
| 2-1 | 0.5 | 8 | 80 | 30×0.3 | 16 | 42 | 1 | 50 | Green compact |
| 2-2 | 20 | 1 | 80 | 30×0.3 | 12 | 36 | 1 | 50 | No film |

FIG.4

| Example 3 | Average particle diameter of raw material (μm) | Specific surface area ($m^2/g$) | Particulate amount (g) | Nozzle opening (mm×mm) | Gas flow rate (L/min) | Differential pressure (kPa) | Rate for driving substrate (mm/s) | Lamination number (pass) | Film thickness (μm) |
|---|---|---|---|---|---|---|---|---|---|
| 3-1 | 2.7 | 6.5 | 50 | 5×0.3 | 5 | 47 | 1 | 30 | 24 |
| 3-2 | 2.7 | 6.5 | 50 | 5×0.3 | 3 | 30 | 1 | 10 | 6 |
| 3-3 | 3.5 | 4.5 | 70 | 30×0.3 | 8 | 30 | 1 | 150 | 20 |
| 3-4 | 3.5 | 4.5 | 70 | 30×0.3 | 7 | 28 | 1 | 50 | 5 |
| 3-5 | 3.5 | 4.5 | 50 | 30×0.3 | 8 | 30 | 1 | 120 | 20 |
| 3-6 | 2.2 | 5.1 | 80 | 30×0.3 | 8 | 27 | 1 | 50 | 2 |
| 3-7 | 2.2 | 5.1 | 80 | 30×0.3 | 12 | 34 | 1 | 50 | 4 |
| Comparative Example 3 | | | | | | | | | |
| 3-1 | 0.47 | 21.6 | 80 | 5×0.3 | 5 | 47 | 1 | 50 | Green compact |
| 3-2 | 0.58 | 82.7 | 50 | 5×0.3 | 5 | 47 | 1 | 20 | Green compact |
| 3-3 | 2.1 | 25 | 50 | 5×0.3 | 7 | 59 | 1 | 10 | Green compact |
| 3-4 | 6 | 12 | 50 | 5×0.3 | 5 | 47 | 1 | 50 | None |
| 3-5 | 2.1 | 7.1 | 80 | 30×0.3 | 12 | 35 | 1 | 50 | None |

FIG.5

METHOD FOR FORMING ZIRCONIA FILM

TECHNICAL FIELD

The present invention relates to a method for forming a zirconia film by an aerosol gas deposition method.

BACKGROUND ART

Zirconia (zirconium oxide) films, which have characteristics for example of their high heat and corrosion resistance, low thermal and electrical conductivity, have been used as heat-resistant protective films, corrosion-resistant protective films, optical thin films and others. These zirconia films have been produced, for example, by a sol-gel method, a thermal chemical vapor deposition (CVD) method, a sputtering method, or a thermal spreading method, but these deposition methods have some problems, such as deposition rate, deposition condition and film quality, to be improved.

An aerosol gas deposition method is a deposition method of converting raw material fine particles (aerosol raw material) placed in an aerosol-generating container to aerosol by agitation with a gas, conveying the aerosol by the gas stream generated by the pressure difference between the aerosol-generating container and the deposition chamber and thus, making it collide and deposit on a substrate. In the method, a film is formed, as the kinetic energy of the raw material fine particles accelerated to high speed is locally converted to heat energy. Since the substrate heating occurs only locally, the substrate is hardly affected by the heat (normal-temperature deposition) and the deposition rate is higher than that of other deposition methods. For that reason, it can generally give a film having high-density, high-adhesiveness.

For example, the methods described in Patent Documents 1 and 2 are known as the aerosol gas deposition methods using zirconia fine particles as raw material.

Patent Document 1 discloses a "method for forming a brittle material fine particle deposited film at low temperature," which forms a thin film of a brittle material by an aerosol gas deposition method from brittle material fine particles containing zirconia fine particles as raw material. It is possible according to the method to form a dense and highly adhesive film by using fine particles in the non-spherical indefinite shape as aerosol raw material, because the impact force concentrates on the projections of the fine particles.

Patent Document 2 discloses a "tool material for baking ceramics for electronic parts," which forms a zirconia-containing surface layer by the aerosol deposition method. It is possible according to the method to prevent separation of a zirconia-containing surface layer from its substrate, by forming an intermediate layer having a linear thermal expansion coefficient between those of the substrate and zirconia on the substrate.

Patent Document 1: Japanese Patent Application Laid-open No. 2003-73855 (paragraph [0010] and FIG. 1)

Patent Document 2: Japanese Patent Application Laid-open No. 2008-137860 (paragraph [0021])

DISCLOSURE OF THE INVENTION

Problem to be Solved by the Invention

However, it is considered difficult to form a zirconia film with favorable film quality by the deposition methods described in Patent Documents 1 and 2.

In the deposition method described in Patent Document 1, several materials (lead titanate zirconate, zirconia, titanium nitride, etc.) are cited as the brittle materials, and the particle shape and the particle diameter (0.1-1 μm) thereof are specified. However, only evaluation results when a film is formed by using lead titanate zirconate as the aerosol raw material are disclosed in the embodiments, and it is unclear whether a similar condition is also applicable to zirconia that is different in physical properties.

Alternatively, the deposition method described in Patent Document 2 describes a case where a film is formed by using a zirconia powder (mean diameter: 0.45 μm) as the aerosol raw material. However, according to the deposition method, the zirconia film is formed on an intermediate layer formed on a substrate for prevention of separation thereof from the substrate and the zirconia film is said to be vulnerable to cracking and separation, if it is formed directly on the substrate.

As described above, there was no known method of forming a zirconia thin film superior in film quality directly on a substrate by the aerosol gas deposition method. The inventors have made studies, particularly focusing on the properties (mean particle diameter, particle diameter distribution, etc.) of zirconia fine particles, which were used as aerosol raw material, but could not obtain a zirconia thin film with favorable film quality, even when zirconia fine particles having the mean diameter described in Patent Documents 1 and 2 described above were used.

Under the circumstances above, an object of the present invention is to provide a method for forming a zirconia film, which is capable of obtaining favorable film quality by an aerosol gas deposition method.

Means for Solving the Problem

The method for forming a zirconia film according to an embodiment of the present invention, which was made to achieve the object above, includes placing zirconia fine particles having a mean particle diameter of 0.7 μm or more and 11 μm or less and a specific surface area of 1 $m^2/g$ or more and 7 $m^2/g$ or less in a closed container.

Aerosol of the zirconia fine particles is generated by introducing a gas into the closed container.

The aerosol is entrained through a transfer pipe connected to the closed container into a deposition chamber kept at a pressure lower than that of the closed container.

The zirconia fine particles deposit on a substrate placed in the deposition chamber.

BRIEF DESCRIPTION OF DRAWINGS

FIG. 3 is a table showing the results obtained in Example 1 and Comparative Example 1 of the present invention.

FIG. 4 is a table showing the results obtained in Example 2 and Comparative Example 2 of the present invention.

FIG. 5 is a table showing the results obtained in Example 3 and Comparative Example 3 of the present invention.

BEST MODE(S) FOR CARRYING OUT THE INVENTION

Figure 1:
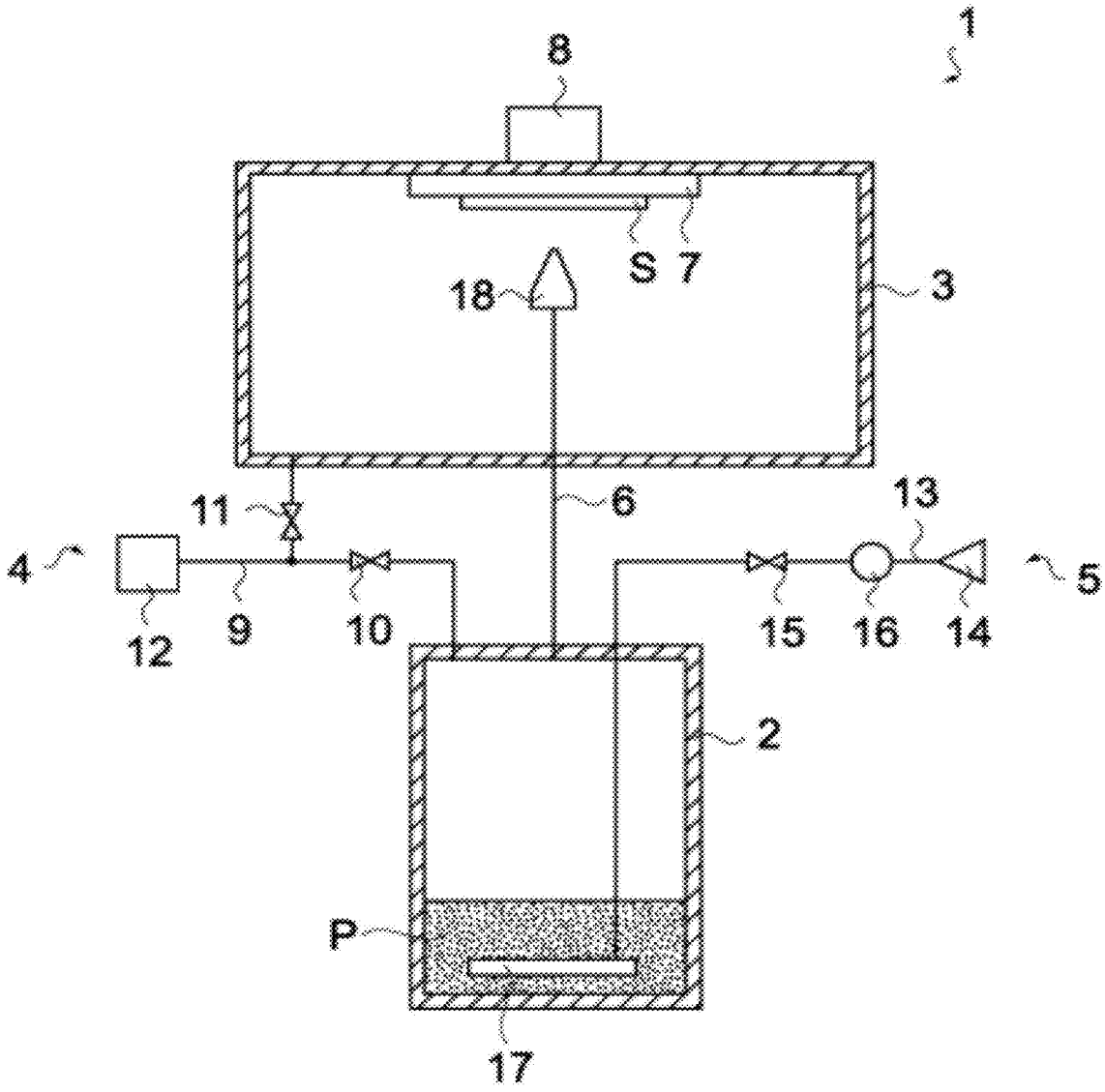
FIG. 1 is a schematic view illustrating the configuration of the aerosol gas deposition apparatus according to an embodiment of the present invention.

The method for forming a zirconia film according to an embodiment of the present invention includes placing zirconia fine particles having a mean particle diameter of 0.7 μm or more and 11 μm or less and a specific surface area of 1 $m^2/g$ or more and 7 $m^2/g$ or less in a closed container.

An aerosol of the zirconia fine particles is formed, as a gas is introduced into the closed container.

The aerosol is entrained into a deposition chamber kept at a pressure lower than that of the closed container, through a transfer pipe connected to the closed container above.

The zirconia fine particles deposit on a substrate placed in the deposition chamber.

It is possible, by using zirconia particles having a mean particle diameter of 0.7 μm or more and 11 μm or less and a specific surface area of 1 $m^2/g$ or more and 7 $m^2/g$ or less as the aerosol raw material, to form a zirconia film having favorable film qualities (high density, high adhesion strength, etc.) on a substrate. Normally, the raw material fine particles for use as the aerosol raw material in aerosol gas deposition method are generally those having a particle diameter of about 0.1 μm to 1 μm. It is because various materials are converted into films favorably, if the particles have a particle diameter in the range above, and raw material fine particles having a particle diameter in the range above can be converted to aerosol easily. On the other hand, after studies, the inventors have found that it is possible to form a zirconia film with favorable film quality by using zirconia fine particles having a particle diameter larger than that of commonly used particles.

The term "mean particle diameter," as used in the present description, means an integrated value (%) at 50% ($D_{50}$) of the particle size distribution, as determined by a laser-diffraction particle size distribution measurement method. The value of the mean particle diameter used was a value determined by using a laser-diffraction particle size analyzer "SALD2000" manufactured by Shimadzu Corporation. Alternatively, the "specific surface area" is a value determined by a gas adsorption method, and here, values obtained by using "Flowsorb II2300" manufactured by Shimadzu Corporation. were used.

The zirconia fine particles include stabilized (partially stabilized) zirconia fine particles containing a rare-earth metal oxide such as yttria and also high-purity zirconia fine particles. The stabilized zirconia and the partially stabilized zirconia are often differentiated by the amount of the oxide added. In this kind of stabilized zirconia film, solid solubilization of the oxide in zirconia crystal leads to stabilization or quasi-stabilization of the crystal structure and thus, destruction of the film by fluctuation in temperature is suppressed. Thus, zirconia films formed with stabilized (partially stabilized) zirconia fine particles are superior in heat resistance and have wider industrial application. Alternatively, zirconia films formed with high-purity zirconia fine particles have an advantage that the properties derived from zirconia can be reflected as they are in the film properties.

When a zirconia film is formed by using stabilized (partially stabilized) zirconia fine particles as the zirconia fine particles, the mean particle diameter of the zirconia fine particles is preferably 1 μm or more and 5 μm or less and the specific surface area is preferably 1 $m^2/g$ or more and 4 $m^2/g$ or less. When the mean particle diameter of the zirconia fine particles is less than 1 μm or the specific surface area is more than 4 $m^2/g$, it is difficult to deposit the particles densely and form a film, often giving a low-density green compact. In a more favorable embodiment, the mean particle diameter of the zirconia fine particles is 1.9 μm or more and 4.6 μm or less.

The yttria content in the zirconia fine particles is not particularly limited, but may be, for example, 8 wt % or more and 14 wt % or less (or 4.5 mol % or more and 8 mol % or less). According to the method for forming a zirconia film, it is possible to obtain excellent film-formability by using zirconia fine particles containing yttria in an amount in the range above. In addition, the zirconia fine particles may contain, besides yttria, other oxides.

On the other hand, high-purity zirconia fine particles are grouped into zirconia fine particles prepared by a dry method and zirconia fine particles prepared by a wet method. The fine particle properties of the zirconia fine particles vary to some extent, depending on the production method, and it is possible to form a zirconia film having desired film properties reliably by selecting the mean particle diameter and the specific surface area depending on the production method.

For example when zirconia fine particles prepared by a dry method are used, zirconia fine particles having a mean fine particle diameter of 0.7 μm or more and 11 μm or less and a specific surface area of 1 $m^2/g$ or more and 6.5 $m^2/g$ or less are favorable. When the mean particle diameter of the zirconia fine particles is less than 0.7 μm, it is difficult of form a dense film, often giving a low-density green compact (powdery compact). A mean particle diameter of more than 11 μm often leads to deterioration in adhesion strength, which in turn leads to separation of the film and also formation of green compact, and is thus unfavorable. In a more favorable embodiment, the mean particle diameter of the zirconia fine particles is 0.7 μm or more and 10.2 μm or less.

The dry method is one of the methods of producing fine particles of solid or liquid physically (break-down methods) and, for example, a production method using electric fusion can be employed. In the production method, the raw material is first converted to large lumps by fusion. The lumps are then pulverized and classified, to give fine particles having a predetermined particle diameter. It is possible to obtain zirconia fine particles having a mean particle diameter of 1 μm or less more reliably by a dry method as compared to a wet method.

Alternatively when zirconia fine particles prepared by the wet method are used, zirconia fine particles having a mean fine particle diameter of 2 μm or more and 4 μm or less and a specific surface area of 4 $m^2/g$ or more and 7 $m^2/g$ or less are favorable. When the mean particle diameter of the zirconia fine particles is less than 2 μm, it is difficult to form a dense film, often giving a low-density green compact (powdery compact). A mean particle diameter of more than 4 μm is unfavorable, as it leads to deterioration in adhesion strength, which in turn leads to separation of the film and generation of green compact. In a more favorable embodiment, the mean particle diameter of the zirconia fine particles is 2.2 μm or more and 3.5 μm or less.

The wet method is a method of preparing by building up fine particles from atoms and molecules, such as a chemical vapor deposition method or a liquid-phase synthesis method. It is possible to obtain high-purity zirconia fine particles more easily by a wet method as compared to a dry method. The mean particle diameter of the zirconia fine particles obtained by the wet method is typically the mean particle diameter of the secondary particles, i.e., aggregates of primary particles.

The method for forming a zirconia film above may include additionally a step of degassing the zirconia fine particles before the step of placing the zirconia fine particles in the closed container.

It is possible by degas of the zirconia fine particles to prevent aggregation of the zirconia fine particles by water or contamination of the thin film by impurities.

In the step of generating aerosol, the zirconia fine particles may be agitated and mixed in the gas, as the gas is blown out from a gas-blowout unit embedded in the zirconia fine particles contained in the closed container.

The zirconia fine particles according to the embodiments of the present invention have a relatively large particle diameter, as described above, but it is possible to convert the particles to aerosol favorably by blowing the gas out through the zirconia fine particles.

Hereinafter, embodiments of the present invention will be described with reference to drawings.

FIG. 1 is a schematic view illustrating the configuration of an aerosol gas deposition apparatus 1 (hereinafter, AGD apparatus 1) according to an embodiment of the present invention.

As shown in the Figure, the AGD apparatus 1 has an aerosol-generating container 2, a deposition chamber 3, an exhaust system 4, a gas-supplying system 5, and a transfer pipe 6. The aerosol-generating container 2 and the deposition chamber 3 form respective independent chambers, which are connected to each other by the transfer pipe 6. The exhaust system 4 is connected to the aerosol-generating container 2 and the deposition chamber 3. The gas-supplying system 5 is connected to the aerosol-generating container 2. An aerosol raw material P is placed in the aerosol-generating container 2. A substrate S is placed in the deposition chamber 3.

The aerosol-generating container (closed container) 2 stores the aerosol raw material P and generates aerosol therein. The aerosol-generating container 2 has a tightly sealable structure with a capped region not shown in the Figure for introduction and removal of the aerosol raw material P. The aerosol-generating container 2 is connected to the exhaust system 4 and the gas-supplying system 5. The aerosol-generating container 2 may have additionally a vibration mechanism of vibrating the aerosol-generating container 2 for agitation of the aerosol raw material P or heating means of heating the container for degas (removal of water and the like) of the aerosol raw material P.

The deposition chamber 3 stores a substrate S. The deposition chamber 3 is configured to keep its internal pressure constant. The deposition chamber 3 is connected to the exhaust system 4. The deposition chamber 3 has a stage 7 for fixation of the substrate S and a stage-driving mechanism 8 for movement of the stage 7. The stage 7 may have heating means of heating the substrate S for degassing of the substrate S before film formation. In addition, the deposition chamber 3 may have a vacuum gauge indicating the internal pressure.

The exhaust system 4 evacuates the aerosol-generating container 2 and the deposition chamber 3 under vacuum. The exhaust system 4 has a vacuum pipe 9, a first valve 10, a second valve 11, and a vacuum pump 12. The vacuum pipe 9 connected to the vacuum pump 12 is branched and connected to the aerosol-generating container 2 and the deposition chamber 3. The first valve 10 is installed on the vacuum pipe 9 between the branch point of the vacuum pipe 9 and the aerosol-generating container 2 in such a manner that vacuum evacuation of the aerosol-generating container 2 can be blocked. The second valve 11 is installed on the vacuum pipe 9 between the branch point of the vacuum pipe 9 and the deposition chamber 3 in such a manner that vacuum evacuation of the deposition chamber 3 can be blocked. The configuration of the vacuum pump 12 is not particularly limited, and the vacuum pump 12 may have multiple pump units. The vacuum pump 12 may be, for example, a mechanical booster pump and a rotary pump that are connected in series.

The gas-supplying system 5 supplies a carrier gas for specifying the pressure of the aerosol-generating container 2 and generating aerosol to the aerosol-generating container 2. The carrier gas is, for example, $N_2$, Ar, He or the like. The gas-supplying system 5 has a gas pipe 13, a gas source 14, a third valve 15, a gas flowmeter 16, and a gas-blowout unit 17. The gas source 14 and the gas-blowout unit 17 are connected to each other through the gas pipe 13 and the third valve 15 and the gas flowmeter 16 are installed on the gas pipe 13. The gas source 14, for example a gas cylinder, supplies the carrier gas. The gas-blowout unit 17, which is installed in the aerosol-generating container 2, blows out the carrier gas supplied through the gas pipe 13 uniformly. The gas-blowout unit 17, which may be for example a hollow unit having many gas-blowout holes, converts the aerosol raw material P to aerosol by effective agitation, as it is located at the position embedded in the aerosol raw material P. The gas flowmeter 16 indicates the flow rate of the carrier gas flowing in the gas pipe 13. The third valve 15 is configured to be capable of regulating the flow rate of the carrier gas flowing in the gas pipe 13 or blocking of the carrier gas.

The transfer pipe 6 conveys the aerosol formed in the aerosol-generating container 2 into the deposition chamber 3. The transfer pipe 6 is connected to the aerosol-generating container 2 at one end and to a nozzle 18 at the other end. The nozzle 18 has a small round or slit-shaped opening and the blowout rate of the aerosol is regulated by the diameter of the opening of nozzle 18, as will be described below. The nozzle 18 is installed at a position facing the substrate S and may be connected to a nozzle-driving mechanism specifying the position and the angle of the nozzle 18 for adjustment of the distance and angle of the ejected aerosol to the substrate S.

The substrate S is made of a material such as glass, metal, or ceramic. As described above, the AGD method is a deposition method performed at normal temperature and also a physical deposition method without any chemical processing, and thus, allows a wide variety of selection of materials as the substrate. In addition, the substrate S is not limited to a flat shape and may be three-dimensional.

The AGD apparatus 1 is configured in such a manner. The configuration of the AGD apparatus 1 is not limited to that described above. For example, a gas-supplying mechanism different from the gas-supplying system 5, which is connected to the aerosol-generating container 2, may be installed additionally. In the configuration described above, the pressure in the aerosol-generating container 2 is adjusted and the aerosol is formed by agitation of the aerosol raw material P by the carrier gas supplied by the gas-supplying system 5. It is possible, by supplying the gas for pressure adjustment separately from separate gas-supplying means, to regulate the pressure in the aerosol-generating container 2, independently of the generation state of aerosol (generation amount, diameter of the main particles agitated, etc.).

Hereinafter, the aerosol raw material P will be explained.

The aerosol raw material P is converted to aerosol in the aerosol-generating container 2 and deposited on the substrate S as a film. The aerosol raw material P used is zirconia fine particles having a mean particle diameter of 0.7 μm or more and 11 μm or less and a specific surface area of 1 $m^2/g$ or more and 7 $m^2/g$ or less. In the present embodiment, the zirconia fine particles include stabilized (including partially stabilized) zirconia fine particles and high-purity zirconia fine particles. The high-purity zirconia fine particles also include zirconia fine particles prepared by the dry method and zirconia fine particles prepared by the wet method. Favorable ranges of the mean particle diameter and the specific surface area of the fine particles may be specified in accordance with the kind of these zirconia fine particles, as follows.

[Stabilized Zirconia Fine Particles]

The stabilized zirconia fine particles are fine particles of zirconia containing at least yttria ($Y_2O_3$) (stabilized zirconia, partially stabilized zirconia). When this kind of zirconia fine particles is used as the aerosol raw material P, the mean particle diameter thereof is 1 μm or more and 5 μm or less and the specific surface area is 1 $m^2/g$ or more and 4 $m^2/g$ or less. It is possible to form a zirconia thin film having favorable properties (denseness, adhesiveness to substrate S, and the like) by using zirconia fine particles having an mean particle diameter of 1 μm or more and 5 μm or less as the aerosol raw material. When the mean particle diameter of the zirconia fine particles is less than 1 μm or the specific surface area is more than 4 $m^2/g$, it is difficult to deposit the particles densely and form a film, often giving a low-density green compact. A mean particle diameter of more than 5 μm may lead to deterioration in adhesion strength, causing film separation and giving a green compact (powdery compact).

Even when the mean particle diameter is 1 μm or more and 5 μm or less, if the particle diameter distribution is not uniform and small-diameter particles and large-diameter particles are contained in a great amount, the specific surface area deviates from the range of 1 $m^2/g$ or more and 4 $m^2/g$ or less. Aerosol raw materials normally used in the AGD method generally have a particle diameter of about 0.1 μm to 1 μm, while the aerosol raw material P in the present embodiment has a particle diameter larger than that.

The content of yttria in the zirconia fine particles is not particularly limited, but may be, for example, 8 wt % or more and 14 wt % or less (4.5 mol % or more and 8 mol % or less). It is possible according to the method for forming a zirconia film to obtain excellent film-formability, by using zirconia fine particles containing yttria in an amount in the range above.

The yttria-containing zirconia fine particles having a mean particle diameter of 1 μm or more and 5 μm or less and a specific surface area of 1 $m^2/g$ or more and 4 $m^2/g$ or less for use may be, for example, stabilized zirconia fine particles "KYZ-8" (product name) (mean particle diameter: 1.9 μm, specific surface area: 3.1 $m^2/g$) produced by Daiichi Kigenso Kagaku Kogyo Co., Ltd.

Alternatively, zirconia fine particles having a particle diameter in the range above may be prepared by pulverization and classification of zirconia fine particles having a relatively large particle diameter. The method of producing the zirconia fine particles is not particularly limited and, for example, known methods such as wet and dry methods can be used.

[High-Purity Zirconia Fine Particles (Dry Method)]

The high-purity zirconia fine particles prepared by a dry method for use are, for example, high-purity zirconia fine particles having a $ZrO_2$+$HfO_2$ purity of 99.50% or more. The mean particle diameter of this kind of zirconia fine particles, when used as the aerosol raw material P, is 0.7 μm or more and 11 μm or less, and the specific surface area thereof is 1 $m^2/g$ or more and 6.5 $m^2/g$ or less. It is possible to form a zirconia thin film having favorable properties (density, adhesiveness to substrate S, and the like) by using zirconia fine particles having a mean particle diameter of 0.7 μm or more and 11 μm or less as the aerosol raw material. When the mean particle diameter of the zirconia fine particles is less than 0.7 μm, it is difficult to form a dense film, often giving a low-density green compact (powdery compact). A mean particle diameter of larger than 11 μm may lead to deterioration in adhesion strength, causing film separation or giving a green compact.

Even when the mean particle diameter is 0.7 μm or more and 11 μm or less, if the particle diameter distribution is not uniform and small-diameter particles and large-diameter particles are contained in a great amount, the specific surface area deviates from the range of 1 $m^2/g$ or more and 6.5 $m^2/g$ or less. The aerosol raw material normally used in the AGD method generally have a particle diameter of about 0.1 μm to 1 μm, while the aerosol raw material P according to the present embodiment has a particle diameter larger than that.

The zirconia fine particles having a mean particle diameter of 0.7 μm or more and 11 μm or less and a specific surface area of 1 $m^2/g$ or more and 6.5 $m^2/g$ or less for use are, for example, BR-3QZ (product name) (mean particle diameter: 2.9 μm, specific surface area: 2.7 $m^2/g$), produced by Daiichi Kigenso Kagaku Kogyo Co., Ltd.

[High-Purity Zirconia Fine Particles (Wet Method)]

The high-purity zirconia fine particles prepared by a wet method for use include, for example, high-purity zirconia fine particles having a $ZrO_2$+HfO2 purity of 99.50% or more. The mean particle diameter of this kind of zirconia fine particles, when used as the aerosol raw material P, is 2 μm or more and 4 μm or less, and the specific surface area thereof is 4 $m^2/g$ or more and 7 $m^2/g$ or less. It is possible to form a zirconia thin film having favorable properties (density, adhesiveness to substrate S, and the like) by using zirconia fine particles having a mean particle diameter of 2 μm or more and 4 μm or less as the aerosol raw material. When the mean particle diameter of the zirconia fine particles is less than 2 μm, it is difficult to form a film, while a mean particle diameter of larger than 4 μm may lead to deterioration in adhesion strength, causing film separation or giving a green compact (powdery compact).

Even when the mean particle diameter is 2 μm or more and 4 μm or less, if the particle diameter distribution is not uniform and small-diameter particles and large-diameter particles are contained in a great amount, the specific surface area deviates from the range of 4 $m^2/g$ or more and 7 $m^2/g$ or less. Aerosol raw materials normally used in the AGD method generally have a particle diameter of about 0.1 μm to 1 μm, while the aerosol raw material P according to the present embodiment has a particle diameter larger than that.

The zirconia fine particles having a mean particle diameter of 2 μm or more and 4 μm or less and a specific surface area of 4 $m^2/g$ or more and 7 $m^2/g$ or less for use are, for example, SPZ zirconium oxide (product name) ($ZrO_2$+$HfO_2$ purity: 99.50% or more, mean particle diameter: 2.5 to 4 μm, specific surface area: 4 to 7 $m^2/g$) produced by Daiichi Kigenso Kagaku Kogyo Co., Ltd.

Figure 2:
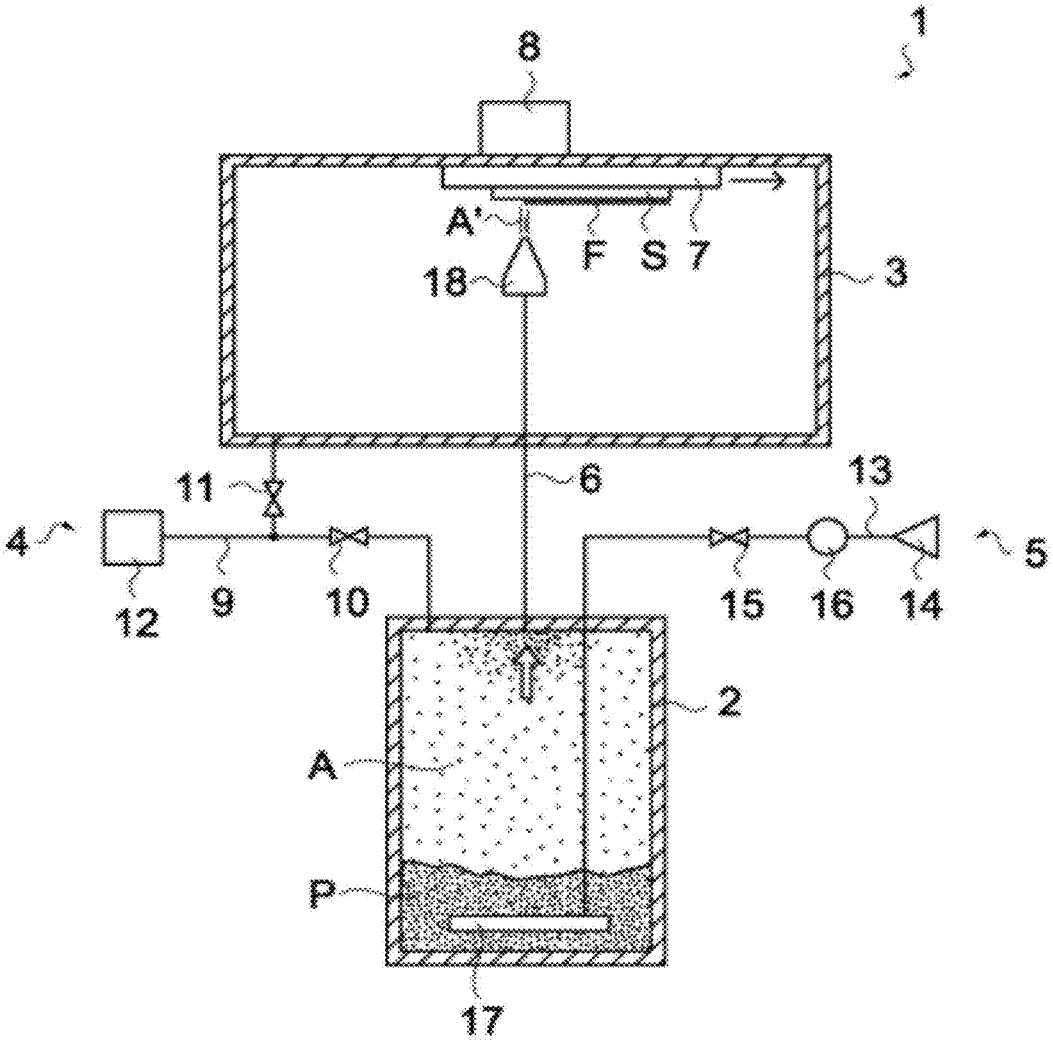
FIG. 2 is a view illustrating the mechanism of the film formation by the aerosol gas deposition method according to an embodiment of the present invention.

Hereinafter, the AGD method performed by using the AGD apparatus 1 and the aerosol raw material P will be described. FIG. 2 is a schematic view illustrating the mechanism for formation of the zirconia thin film by the AGD method according to the present embodiment.

A particular amount of aerosol raw material P is placed in the aerosol-generating container 2. The aerosol raw material P may be previously degassed under heat. Alternatively, the aerosol-generating container 2 may be heated with the aerosol raw material P placed inside, for degas of the aerosol raw material P. It is possible by degas of the zirconia fine particles to prevent aggregation of the zirconia fine particles by water or contamination of the thin film with impurities.

Subsequently, the aerosol-generating container 2 and the deposition chamber 3 are evacuated under vacuum by the exhaust system 4.

The first valve 10 and the second valve 11 are turned open while the vacuum pump 12 is in operation for vacuum evacuation of the aerosol-generating container 2 and the deposition chamber 3 to a sufficiently low pressure. When the aerosol-generating container 2 is evacuated sufficiently, the first valve 10 is turned closed. The deposition chamber 3 is vacuum-evacuated during film formation.

A carrier gas is then introduced into the aerosol-generating container 2 by the gas-supplying system 5. The third valve 15 is turned open, and the carrier gas is blown out through the gas-blowout unit 17 into the aerosol-generating container 2.

The pressure of the aerosol-generating container 2 increases by the carrier gas introduced into the aerosol-generating container 2. On the other hand, the deposition chamber 3 is under vacuum evacuation, and thus, the carrier gas flows toward the transfer pipe 6 connecting with the deposition chamber 3. The aerosol raw material P is agitated by the carrier gas blown out from the gas-blowout unit 17, as shown in FIG. 2 and floats in the aerosol-generating container, forming an aerosol containing the aerosol raw material P dispersed in the carrier gas (shown by A in FIG. 2). The aerosol generated flows into the transfer pipe 6 by the pressure difference between the aerosol-generating container 2 and the deposition chamber 3 and is ejected from the nozzle 18. It is possible to control the pressure difference between the aerosol-generating container 2 and the deposition chamber 3 and the state of aerosol formation by adjustment of the opening of the third valve 15.

The aerosol raw material P according to the present embodiment, i.e., zirconia fine particles, is large compared to commonly used aerosol raw materials, and thus, it is difficult to agitate it. It is possible to agitate and disperse the aerosol raw material P effectively, by blowing out the carrier gas from the gas-blowout unit 17 embedded in the aerosol raw material P.

The aerosol blown out from the nozzle 18 (indicated by A' in FIG. 2) is ejected at a flow rate determined by the pressure difference between the aerosol-generating container 2 and the deposition chamber and the diameter of the opening of the nozzle 18. The aerosol is carried to the surface of the substrate S or a previously formed film, the aerosol raw material P, i.e., zirconia fine particles, contained in the aerosol collides with the surface of the substrate S or the previously formed film. The kinetic energy of the aerosol raw material P is converted locally to heat energy, leading to complete or partial bonding of the particles by fusion and formation of a film. In this way, the particle diameter of the aerosol raw material P has a significant influence on the magnitude of the kinetic energy of the fine particles and the degree of fusion. More specifically, the quality of the formed film depends on the particle diameter of the zirconia fine particles.

A zirconia thin film (indicated by F in FIG. 2) is formed in a predetermined region of the substrate S, when the substrate S is moved. The relative position of the substrate S to the nozzle 18 varies by movement of the stage 7 by the stage-driving mechanism 8. It is possible by moving the stage 7 in the direction in parallel with the deposition face of the substrate S to form a linear thin film having a width identical with the diameter of the opening of nozzle 18. It is possible to further form a film on a previously-formed film by reciprocal movement of the stage 7 and thus to form a zirconia thin film having a predetermined film thickness. In addition, two-dimensional movement of the stage 7 gives a thin film formed in a predetermined region. The angle of the nozzle 18 to the deposition face of the substrate S may be vertical or inclined. If the nozzle 18 is placed, as inclined to the deposition face, even if the aggregates of fine particles that may impair the film quality deposit, it is possible to remove the deposit.

The zirconia thin film is formed in such a manner. As described above, it is possible, by using zirconia fine particles having a mean particle diameter of 0.7 μm or more and 11 μm or more and a specific surface area of 1 $m^2/g$ or more and 7 $m^2/g$ or less as the aerosol raw material P, to form a zirconia thin film that is dense and highly adhesive to the substrate S.

Hereinafter, Examples and Comparative Examples of the present invention will be described. Here, the AGD apparatus 1 above is used for description.

EXAMPLES

Example 1

Multiple kinds of stabilized zirconia fine particles different in mean particle diameter and specific surface area were prepared, and a zirconia film was formed by using these particles as aerosol raw materials by means of a gas deposition method and the quality of the films was evaluated. Results of the following Examples (1-1)-(1-4) and Comparative Examples (1-1)-(1-5) are shown in FIG. 3.

Example 1-1

Eighty grams of stabilized zirconia fine particles (product name: "KYZ-8") produced by Daiichi Kigenso Kagaku Kogyo Co., Ltd. ($Y_2O_3$ content: 13.8 wt %, mean particle diameter: 1.9 μm ($D_{50}$), specific surface area: 3.1 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The differential pressure between the aerosol-generating container 2 and the deposition chamber 3 was 34 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 100, and thus, the lamination number was set to 200 (passes). A translucent whitish zirconia thin film having a width of 30 mm, a length of 15 mm, and a film thickness of 16 μm (0.08 μm/pass) was obtained. The thin film was dense and favorably adhesive to the substrate S (no separation observed after peel test with an adhesive tape).

Example 1-2

One hundred g of partially stabilized zirconia fine particles (product name: "UZY-8H#4000") produced by Daiichi Kigenso Kagaku Kogyo Co., Ltd. ($Y_2O_3$ content: 8.03 wt %, mean particle diameter: 4.6 μm ($D_{50}$), specific surface area: 1.7 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 14 L/min. The differential pressure between the aerosol-generating container 2 and the deposition chamber 3 was 38 kPa. The aerosol raw material P in the aerosol-generating container 2 was converted to aerosol, which was ejected through a transfer pipe 6 out of the nozzle 18, to form a film on a substrate (alumina) S.

A stage 7 carrying the substrate S thereon was driven for a distance of 15 mm at a rate of 2 mm/s by a stage-driving mechanism 8, the driving direction of the stage 7 was repeatedly reversed, and the stage 7 was caused to reciprocate. The reciprocation number was set to 100, and thus, the lamination number was set to 200 (passes). A translucent whitish zirconia thin film having a width of 30 mm, a length of 15 mm, and a film thickness of 21 μm (0.11 μm/pass) was obtained. The thin film was dense and favorably adhesive to the substrate S (no separation observed after peel test with an adhesive tape).

Example 1-3

One hundred g of partially stabilized zirconia fine particles (product name: "UZY-8H#4000") produced by Daiichi Kigenso Kagaku Kogyo Co., Ltd. ($Y_2O_3$ content: 8.03 wt %, mean particle diameter: 4.6 μm ($D_{50}$), specific surface area: 1.7 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The differential pressure between the aerosol-generating container 2 and the deposition chamber 3 was 34 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A translucent whitish zirconia thin film having a width of 30 mm, a length of 15 mm, and a film thickness of 12 μm (0.24 μm/pass) was obtained. The thin film was dense and favorably adhesive to the substrate S (no separation observed after peel test with an adhesive tape).

Example 1-4

Eighty grams of partially stabilized zirconia fine particles (product name: "KYZ-4.5") produced by Daiichi Kigenso Kagaku Kogyo Co., Ltd. ($Y_2O_3$ content: 8.01 wt %, mean particle diameter: 2.0 μm ($D_{50}$), specific surface area: 3.7 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The differential pressure between the aerosol-generating container 2 and the deposition chamber 3 was 34 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A translucent whitish zirconia thin film having a width of 30 mm, a length of 15 mm, and a film thickness of 16 μm (0.32 μm/pass) was obtained. The thin film was dense and favorably adhesive to the substrate S (no separation observed after peel test with an adhesive tape).

Comparative Example 1-1

Forty grams of stabilized zirconia fine particles (product name: "HSY-8") produced by Daiichi Kigenso Kagaku Kogyo Co., Ltd. ($Y_2O_3$ content: 13.6 wt %, mean particle diameter: 3.6 μm ($D_{50}$), specific surface area: 12.0 $m^2/g$) were used as the aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The differential pressure between the aerosol-generating container 2 and the deposition chamber 3 was 36 kPa. The aerosol raw material P in the aerosol-generating container 2 was converted to aerosol, which was ejected through a transfer pipe 6 out of a nozzle 18, to be sprayed onto a substrate (alumina) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A green compact of the zirconia fine particles was formed on the substrate. The green compact was porous enough that it could be wiped out.

Comparative Example 1-2

Eighty grams of stabilized zirconia fine particles (product name: "HSY-8") produced by Daiichi Kigenso Kagaku Kogyo Co., Ltd. ($Y_2O_3$ content: 13.7 wt %, mean particle diameter: 56.9 μm ($D_{50}$), specific surface area: 4.3 $m^2/g$) were used as aerosol raw material P. The nozzle 18 used was a slit nozzle having a slit length of 30 mm and a slit width of 0.3 mm.

The aerosol raw material P was placed in an aerosol-generating container 2 and the aerosol-generating container 2 and a deposition chamber 3 were vacuum-evacuated to 10 Pa or less by an exhaust system 4. There was no degas treatment in air. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 10 L/min. The differential pressure between the aerosol-generating container 2 and the deposition chamber 3 was 32 kPa. The aerosol raw material P in the aerosol-generating container 2 was converted to aerosol, which was ejected through a transfer pipe 6 out of the nozzle 18, to be sprayed onto a substrate (alumina) S.

The stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes).

The zirconia thin film formed was less adhesive to the substrate S and observed to be separated from the substrate in the peel test with an adhesive tape.

Comparative Example 1-3

Eighty grams of stabilized zirconia fine particles (product name: "KYZ-8-15") produced by Daiichi Kigenso Kagaku Kogyo Co., Ltd. ($Y_2O_3$ content: 14.2 wt %, mean particle diameter: 13.7 μm ($D_{50}$), specific surface area: 0.4 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 6 L/min. The differential pressure between the aerosol-generating container 2 and the deposition chamber 3 was 26 kPa. The aerosol raw material P in the aerosol-generating container 2 was converted to aerosol, which was ejected through a transfer pipe 6 out of the nozzle 18, to be sprayed onto a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). Observation during film deposition showed that the deposited film was less adhesive and partial deposition and delamination occurred repeatedly after lamination.

Comparative Example 1-4

Sixty grams of stabilized zirconia fine particles (product name: "HSY-8") produced by Daiichi Kigenso Kagaku Kogyo Co., Ltd. ($Y_2O_3$ content: 13.7 wt %, mean particle diameter: 0.5 μm ($D_{50}$), specific surface area: 7.2 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The differential pressure between the aerosol-generating container 2 and the deposition chamber 3 was 36 kPa. The aerosol raw material P in the aerosol-generating container 2 was converted to aerosol, which was ejected through a transfer pipe 6 out of the nozzle 18, to be sprayed onto a substrate (alumina) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A green compact of zirconia fine particles was formed on the substrate. The green compact was porous enough that it could be wiped out.

Comparative Example 1-5

Eighty grams of partially stabilized zirconia fine particles (product name: "KYZ-4.5") produced by Daiichi Kigenso Kagaku Kogyo Co., Ltd. ($Y_2O_3$ content: 7.98 wt %, mean particle diameter: 1.8 μm ($D_{50}$), specific surface area: 5.4 $m^2/g$) were used as the aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 12 L/min. The differential pressure between the aerosol-generating container 2 and the deposition chamber 3 was 34 kPa. The aerosol raw material P in the aerosol-generating container 2 was converted to aerosol, which was ejected through a transfer pipe 6 out of the nozzle 18, to be sprayed onto a substrate (alumina) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A green compact of zirconia fine particles was formed on the substrate. The green compact was porous enough that it could be wiped out.

As shown in Examples (1-1) to (1-4) and the Comparative Examples (1-1) to (1-5) above, there was formed a zirconia thin film (stabilized zirconia thin film or partially stabilized zirconia thin film) that is dense and favorably adhesive to the substrate by an aerosol gas deposition method using zirconia fine particles satisfying the conditions of a mean particle diameter of 1 μm or more and 5 μm or less, in particular, 1.9 μm or more and 4.6 μm or less and a specific surface area of 1 $m^2/g$ or more and 4 $m^2/g$ or less as the aerosol raw material. Alternatively when zirconia fine particles not satisfying the conditions are used as the aerosol raw material, there was not formed a favorable zirconia thin film.

Example 2

Multiple kinds of high-purity zirconia fine particles different in mean particle diameter and specific surface area were prepared by a dry method, a zirconia film was formed by using these particles as aerosol raw materials by means of a gas deposition method, and the quality of the films was evaluated. Results of the following Examples (2-1) to (2-6) and Comparative Examples (2-1) to (2-2) are shown in FIG. 4.

Example 2-1

Eighty grams of high-purity zirconia fine particles (product name: "BR-3QZ") produced by Daiichi Kigenso Kagaku Kogyo Co., Ltd. (mean particle diameter: 2.9 μm ($D_5O$), specific surface area: 2.7 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 14 L/min. The differential pressure between the aerosol-generating container 2 and the deposition chamber 3 was 38 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A pale pink zirconia thin film having a width of 30 mm, a length of 15 mm, and a film thickness of 8 μm (0.16 μm/pass) was obtained. The thin film was dense and favorably adhesive to the substrate S (no separation observed after peel test with an adhesive tape).

Example 2-2

Eighty grams of high-purity zirconia fine particles (product name: "BR-QZ") produced by Daiichi Kigenso Kagaku Kogyo Co., Ltd. (mean particle diameter: 7.4 μm ($D_{50}$), specific surface area: 1.6 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 10 L/min. The differential pressure between the aerosol-generating container 2 and the deposition chamber 3 was 32 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A whitish zirconia thin film having a width of 30 mm, a length of 15 mm, and a film thickness of 14 μm (0.28 μm/pass) was obtained. The thin film was dense and favorably adhesive to the substrate S (no separation observed after peel test with an adhesive tape).

Example 2-3

Eighty grams of high-purity zirconia fine particles (product name: "BR-12QZ") produced by Daiichi Kigenso Kagaku Kogyo Co., Ltd. (mean particle diameter: 10.2 μm ($D_{50}$), specific surface area: 1.5 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 8 L/min. The differential pressure between the aerosol-generating container 2 and the deposition chamber 3 was 28 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A whitish zirconia thin film having a width of 30 mm, a length of 15 mm, and a film thickness of 30 μm (0.6 μm/pass) was formed. The thin film was dense and favorably adhesive to the substrate S (no separation observed after peel test with an adhesive tape).

Example 2-4

Eighty grams of high-purity zirconia fine particles (product name: "BR-12QZ") produced by Daiichi Kigenso Kagaku Kogyo Co., Ltd. (mean particle diameter: 10.2 μm ($D_5O$), specific surface area: 1.5 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 4 L/min. The differential pressure between the aerosol-generating container 2 and the deposition chamber 3 was 22 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A whitish zirconia thin film having a width of 30 mm, a length of 15 mm, and a film thickness of 7 μm (0.14 μm/pass) was obtained. The thin film was dense and favorably adhesive to the substrate S (no separation observed after peel test with an adhesive tape).

Example 2-5

Eighty grams of high-purity zirconia fine particles (product name: "TMZ-T") produced by Daiichi Kigenso Kagaku Kogyo Co., Ltd. (mean particle diameter: 0.73 μm ($D_{50}$), specific surface area: 6.1 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 16 L/min. The differential pressure between the aerosol-generating container 2 and the deposition chamber 3 was 42 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A whitish zirconia thin film having a width of 30 mm, a length of 15 mm, and a film thickness of 28 μm (0.56 μm/pass) was obtained. The thin film was dense and favorably adhesive to the substrate S (no separation observed after peel test with an adhesive tape).

Example 2-6

Eighty grams of high-purity zirconia fine particles (product name: "TMZ") produced by Daiichi Kigenso Kagaku Kogyo Co., Ltd. (mean particle diameter: 1.12 μm ($D_{50}$), specific surface area: 4.7 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 12 L/min. The differential pressure between the aerosol-generating container 2 and the deposition chamber 3 was 36 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A whitish zirconia thin film having a width of 30 mm, a length of 15 mm, and a film thickness of 6 μm (0.12 μm/pass) was obtained. The thin film was dense and favorably adhesive to the substrate S (no separation observed after peel test with an adhesive tape).

Comparative Example 2-1

Eighty grams of high-purity zirconia fine particles (product name: "TMZ-T2") produced by Daiichi Kigenso Kagaku Kogyo Co., Ltd. (mean particle diameter: 0.5 μm ($D_{50}$), specific surface area: 8 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 16 L/min. The differential pressure between the aerosol-generating container 2 and the deposition chamber 3 was 42 kPa. The aerosol raw material P in the aerosol-generating container 2 was converted to aerosol, which was ejected through a transfer pipe 6 out of the nozzle 18, to be sprayed onto a substrate (alumina) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). A green compact of zirconia fine particles was formed on the substrate. The green compact was porous enough that it could be wiped out.

Comparative Example 2-2

Eighty grams of high-purity zirconia fine particles (product name: "BR-90G") produced by Daiichi Kigenso Kagaku Kogyo Co., Ltd. (mean particle diameter: 20 μm ($D_{50}$), specific surface area: 1 $m^2/g$) were used as aerosol raw material P. The nozzle 18 used was a slit nozzle having a slit length of 30 mm and a slit width of 0.3 mm.

The aerosol raw material P was placed in an aerosol-generating container 2 and the aerosol-generating container 2 and a deposition chamber 3 was vacuum-evacuated to 10 Pa or less by an exhaust system 4. There was no degas treatment in air. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The differential pressure between the aerosol-generating container 2 and the deposition chamber 3 was 36 kPa. The aerosol raw material P in the aerosol-generating container 2 was converted to aerosol, which was ejected through a transfer pipe 6 out of the nozzle 18, to be sprayed onto a substrate (alumina) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). The zirconia thin film formed was less adhesive to the substrate S and observed to be separated from the substrate in the peel test with an adhesive tape.

As shown in Examples (2-1) to (2-6) and Comparative Examples (2-1) to (2-2) above, there was formed a high-purity zirconia thin film that is dense and favorably adhesive to the substrate, by an aerosol gas deposition method using zirconia fine particles satisfying the conditions of a mean particle diameter of 0.7 μm or more and 11 μm or less, in particular, 0.73 μm or more and 10.2 μm or less and a specific surface area of 1 $m^2/g$ or more and 6.5 $m^2/g$ or less as the aerosol raw material. Alternatively when zirconia fine particles not satisfying the conditions are used as the aerosol raw material, there was not formed a favorable zirconia thin film.

Example 3

Multiple kinds of high-purity zirconia fine particles different in mean particle diameter and specific surface area were prepared by a wet method, a zirconia film was formed by using these particles as aerosol raw materials by means of a gas deposition method, and the quality of the films was evaluated. Results of the following Examples (3-1) to (3-7) and Comparative Examples (3-1) to (3-4) are shown in FIG. 5.

Example 3-1

Fifty grams of high-purity zirconia fine particles (product name: "SPZ") produced by Daiichi Kigenso Kagaku Kogyo Co., Ltd. ($ZrO_2$+$HfO_2$ purity: 99.50% or more, mean particle diameter: 2.7 μm, specific surface area: 6.5 $m^2/g$) were used as aerosol raw material P. The nozzle 18 used was a slit nozzle having a slit length of 5 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 5 L/min. The pressure of the aerosol-generating container 2 was approximately 47 kPa, the pressure of the deposition chamber 3 was 240 Pa, and the differential pressure between the aerosol-generating container 2 and the deposition chamber 3 was 47 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 15, and thus, the lamination number was set to 30 (passes). It took 8 minutes for film formation. A translucent whitish zirconia thin film having a width of 5 mm, a length of 15 mm, and a film thickness of 24 μm (0.8 μm/pass) was obtained. The thin film was dense and favorably adhesive to the substrate S (no separation observed after peel test with an adhesive tape).

Example 3-2

Fifty grams of high-purity zirconia fine particles (product name: "SPZ") produced by Daiichi Kigenso Kagaku Kogyo Co., Ltd. ($ZrO_2$+$HfO_2$ purity: 99.50% or more, mean particle diameter: 2.7 μm, specific surface area: 6.5 $m^2/g$) were used as aerosol raw material P. The nozzle 18 used was a slit nozzle having a slit length of 5 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 3 L/min. The pressure of the aerosol-generating container 2 was approximately 30 kPa, the pressure of the deposition chamber 3 was 170 Pa, and the differential pressure between the aerosol-generating container 2 and the deposition chamber 3 was 30 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 5, and thus, the lamination number was set to 10 (passes). It took 3 minutes for film formation. A translucent whitish zirconia thin film having a width of 5 mm, a length of 15 mm, and a film thickness of 6 μm (0.6 μm/pass) was obtained. The thin film was dense and favorably adhesive to the substrate S (no separation observed after peel test with an adhesive tape).

Example 3-3

Figure 6:
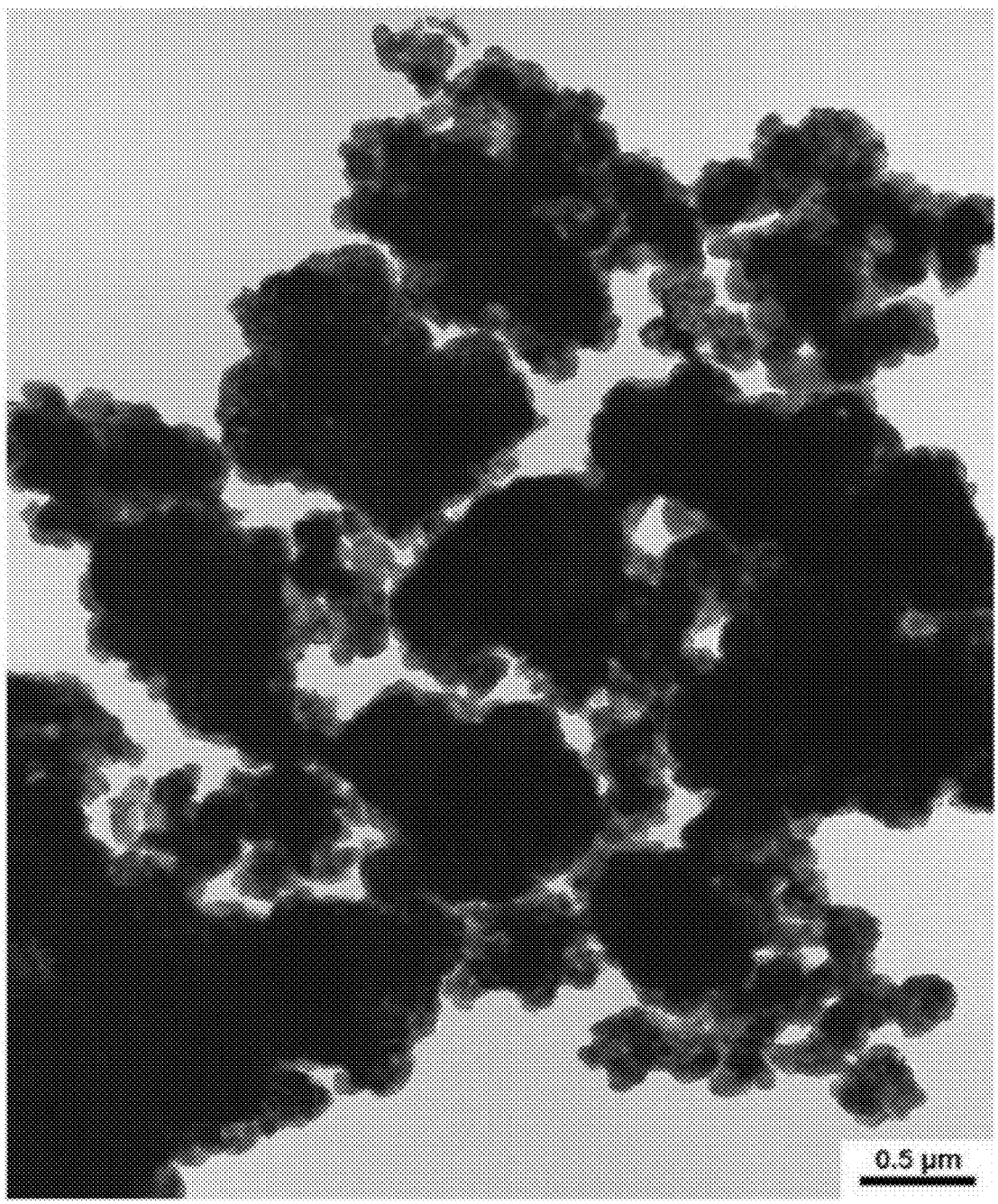
FIG. 6 is a transmission electron micrograph (×40,000) of the zirconia fine particles in Example (3-3).
Figure 7:
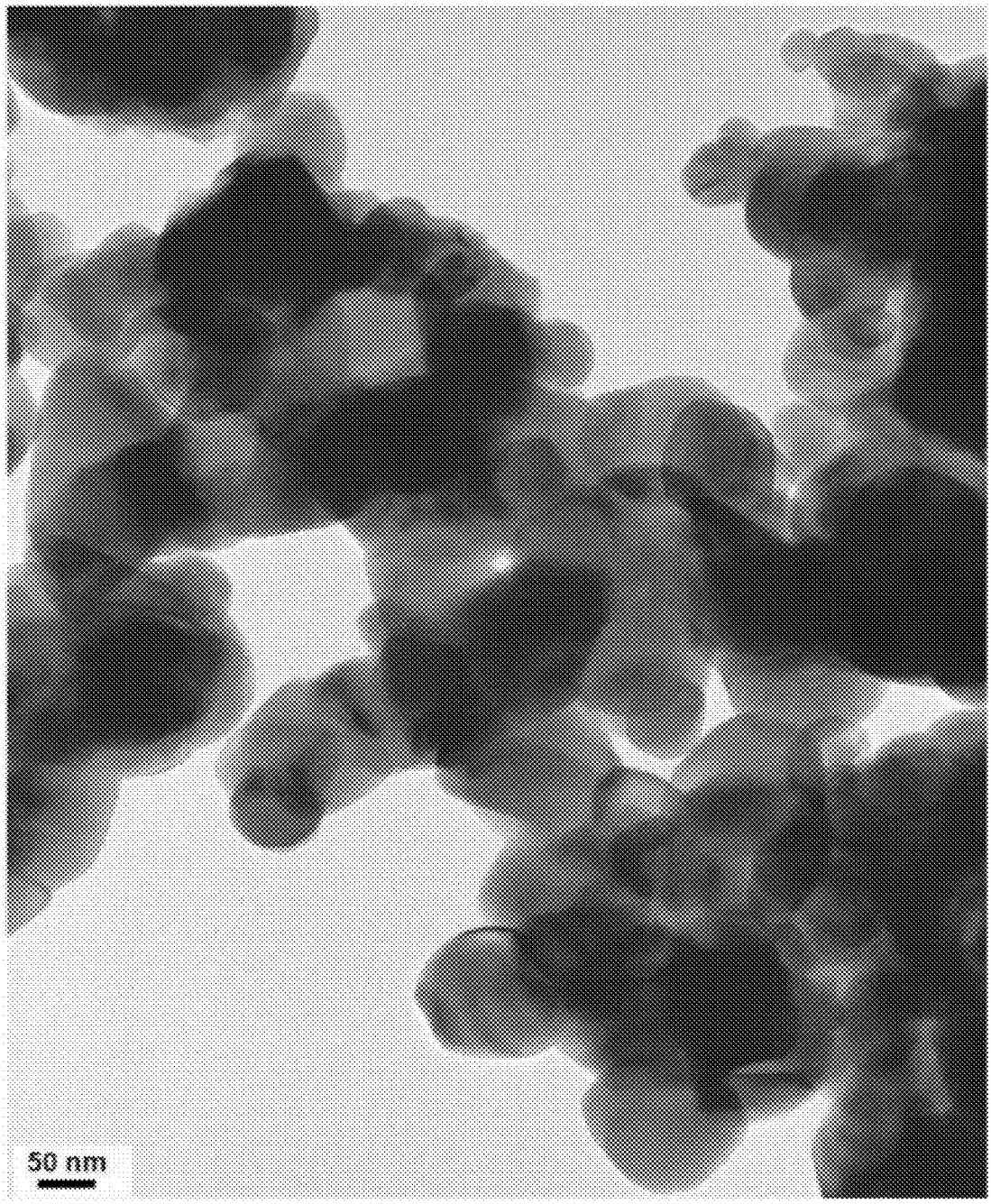
FIG. 7 is a transmission electron micrograph (×200,000) of the zirconia fine particles in Example (3-3).

Seventy grams of high-purity zirconia fine particles (product name: "SPZ") produced by Daiichi Kigenso Kagaku Kogyo Co., Ltd. ($ZrO_2$+$HfO_2$ purity: 99.50% or more, mean particle diameter: 3.5 μm, specific surface area: 4.5 $m^2/g$) were used as aerosol raw material P. FIGS. 6 and 7 are the images of the zirconia fine particles under transmission electron microscope (TEM). FIG. 6 is a TEM image at ×40,000 magnification and FIG. 7 is a TEM image at ×200,000 magnification. The low-magnification TEM image shown in FIG. 6 indicates that smaller-diameter primary particles in the zirconia fine particles coalesce with each other, forming aggregate, i.e., secondary particles having a particle diameter of several μm. Furthermore, there were no primary particles present independently. The high-magnification TEM image shown in FIG. 7 indicates that primary particles having a particle diameter of about 0.1 to 0.2 μm coalesce with each other, forming aggregates. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 8 L/min. The pressure of the aerosol-generating container 2 was approximately 30 kPa, the pressure of the deposition chamber 3 was 400 Pa, and the differential pressure between the aerosol-generating container 2 and the deposition chamber 3 was 30 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 75, and thus, the lamination number was set to 150 (passes). It took 38 minutes for film formation. A translucent whitish zirconia thin film having a width of 30 mm, a length of 15 mm, and a film thickness of 20 μm (0.13 μm/pass) was obtained. The thin film was dense and favorably adhesive to the substrate S (no separation observed after peel test with an adhesive tape).

Example 3-4

Seventy grams of high-purity zirconia fine particles (product name: "SPZ") produced by Daiichi Kigenso Kagaku Kogyo Co., Ltd. ($ZrO_2$+$HfO_2$ purity: 99.50% or more, mean particle diameter: 3.5 μm, specific surface area: 4.5 $m^2/g$) were used as the aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 7 L/min. The pressure of the aerosol-generating container 2 was approximately 28 kPa, the pressure of the deposition chamber 3 was 360 Pa, and the differential pressure between the aerosol-generating container 2 and the deposition chamber 3 was 28 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). It took 13 minutes for film formation. A translucent whitish zirconia thin film having a width of 30 mm, a length of 15 mm, and a film thickness of 5 μm (0.1 μm/pass) was obtained. The thin film was dense and favorably adhesive to the substrate S (no separation observed after peel test with an adhesive tape).

Example 3-5

Fifty grams of high-purity zirconia fine particles (product name: "SPZ") produced by Daiichi Kigenso Kagaku Kogyo Co., Ltd. ($ZrO_2$+$HfO_2$ purity: 99.50% or more, mean particle diameter: 3.5 μm, specific surface area: 4.5 $m^2/g$) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 8 L/min. The pressure of the aerosol-generating container 2 was approximately 30 kPa, the pressure of the deposition chamber 3 was 400 Pa, and the differential pressure between the aerosol-generating container 2 and the deposition chamber 3 was 30 kPa. The aerosol raw material P in the aerosol-generating container 2 was converted to aerosol, which was ejected through a transfer pipe 6 out of the nozzle 18, to form a film on a substrate (Ni-based alloy) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 60, and thus, the lamination number was set to 120 (passes). It took 30 minutes for film formation. A translucent whitish zirconia thin film having a width of 30 mm, a length of 15 mm, and a film thickness of 20 μm (0.17 μm/pass) was obtained. The thin film was dense and favorably adhesive to the substrate S (no separation observed after peel test with an adhesive tape).

Example 3-6

Eighty grams of zirconium oxide fine particles (product name: "EP-5") produced by Daiichi Kigenso Kagaku Kogyo Co., Ltd. ($ZrO_2$+$HfO_2$ purity: 99.50% or more, mean particle diameter: 2.2 μm, specific surface area: 5.1 $m^2$/g) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 8 L/min. The pressure of the aerosol-generating container 2 was approximately 27 kPa, the pressure of the deposition chamber 3 was 360 Pa, and the differential pressure between the aerosol-generating container 2 and the deposition chamber 3 was 27 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). It took 13 minutes for film formation. A translucent whitish zirconia thin film having a width of 30 mm, a length of 15 mm, and a film thickness of 2 μm (0.04 μm/pass) was obtained. The thin film was dense and favorably adhesive to the substrate S (no separation observed after peel test with an adhesive tape).

Example 3-7

Eighty grams of zirconium oxide fine particles (product name: "EP-5") produced by Daiichi Kigenso Kagaku Kogyo Co., Ltd. ($ZrO_2$+$HfO_2$ purity: 99.50% or more, mean particle diameter: 2.2 μm, specific surface area: 5.1 $m^2$/g) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The pressure of the aerosol-generating container 2 was approximately 34 kPa, the pressure of the deposition chamber 3 was 470 Pa, and the differential pressure between the aerosol-generating container 2 and the deposition chamber 3 was 34 kPa. The aerosol raw material P in the aerosol-generating container 2 was converted to aerosol, which was ejected through a transfer pipe 6 out of the nozzle 18, to form a film on a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). It took 13 minutes for film formation. A translucent whitish zirconia thin film having a width of 30 mm, a length of 15 mm, and a film thickness of 4 μm (0.08 μm/pass) was obtained. The thin film was dense and favorably adhesive to the substrate S (no separation observed after peel test with an adhesive tape).

Comparative Example 3-1

Eighty grams of zirconium oxide (product name: "UEP") produced by Daiichi Kigenso Kagaku Kogyo Co., Ltd. ($ZrO_2$+$HfO_2$ purity: 99.80% or more, mean particle diameter: 0.47 μm, specific surface area: 21.6 $m^2$/g) were used as aerosol raw material P. The nozzle 18 used was a slit nozzle having a slit length of 5 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 5 L/min. The pressure of the aerosol-generating container 2 was approximately 47 kPa, the pressure of the deposition chamber 3 was 240 Pa, and the differential pressure between the aerosol-generating container 2 and the deposition chamber 3 was 47 kPa. The aerosol raw material P in the aerosol-generating container 2 was converted to aerosol, which was ejected through a transfer pipe 6 out of the nozzle 18, to be sprayed onto a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). It took 13 minutes for film formation.

A green compact of zirconia fine particles was formed on the substrate. The green compact was porous enough that it could be wiped out.

Comparative Example 3-2

Fifty grams of zirconium oxide (product name: "UEP") produced by Daiichi Kigenso Kagaku Kogyo Co., Ltd. ($ZrO_2$+$HfO_2$ purity: 99.80% or more, mean particle diameter: 0.58 μm, specific surface area: 82.7 $m^2$/g) were used as aerosol raw material P. The nozzle 18 used was a slit nozzle having a slit length of 5 mm and a slit width of 0.3 mm.

The aerosol raw material P was placed in an aerosol-generating container 2 and the aerosol-generating container 2 and a deposition chamber 3 were vacuum-evacuated to 10 Pa or less by an exhaust system 4. There was no degas treatment in air. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 5 L/min. The pressure of the aerosol-generating container 2 was approximately 47 kPa, the pressure of the deposition chamber 3 was 240 Pa, and the differential pressure between the aerosol-generating container 2 and the deposition chamber 3 was 47 kPa. The aerosol raw material P in the aerosol-generating container 2 was converted to aerosol, which was ejected through a transfer pipe 6 out of the nozzle 18, to be sprayed onto a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 10, and thus, the lamination number was set to 20 (passes). It took 5 minutes for film formation.

A green compact of zirconia fine particles was formed on the substrate. The green compact was porous enough that it could be wiped out.

Comparative Example 3-3

Fifty grams of zirconium oxide (product name: "EP") produced by Daiichi Kigenso Kagaku Kogyo Co., Ltd. ($ZrO_2$+$HfO_2$ purity: 99.50% or more, mean particle diameter: 2.1 μm, specific surface area: 25 $m^2$/g) were used as aerosol raw material P. The nozzle 18 used was a slit nozzle having a slit length of 5 mm and a slit width of 0.3 mm.

The aerosol raw material P was placed in an alumina tray and heated at 500° C. under air for 2 hours for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 7 L/min. The pressure of the aerosol-generating container 2 was approximately 59 kPa, the pressure of the deposition chamber 3 was 290 Pa, and the differential pressure between the aerosol-generating container 2 and the deposition chamber 3 was 59 kPa. The aerosol raw material P in the aerosol-generating container 2 was converted to aerosol, which was ejected through a transfer pipe 6 out of the nozzle 18, to be sprayed onto a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 5, and thus, the lamination number was set to 10 (passes). It took 3 minutes for film formation.

A green compact of zirconia fine particles was formed on the substrate. The green compact was so porous that it could be wiped out.

Comparative Example 3-4

Fifty grams of zirconium oxide (product name: "WG-8S") produced by Daiichi Kigenso Kagaku Kogyo Co., Ltd. ($ZrO_2$+$HfO_2$ purity: 99.90% or more, mean particle diameter: 6 μm, specific surface area: 12 $m^2$/g) were used as aerosol raw material P. The nozzle 18 used was a slit nozzle having a slit length of 5 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas supplying system 5 into the aerosol-generating container 2 at a flow rate of 5 L/min. The pressure of the aerosol-generating container 2 was approximately 47 kPa, the pressure of the deposition chamber 3 was 240 Pa, and the differential pressure between the aerosol-generating container 2 and the deposition chamber 3 was 47 kPa. The aerosol raw material P in the aerosol-generating container 2 was converted to aerosol, which was ejected through a transfer pipe 6 out of the nozzle 18, to be sprayed onto a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). It took 13 minutes for film formation. Observation during film deposition showed that the deposited film was less adhesive and partial deposition and delamination occurred repeatedly after lamination.

Comparative Example 3-5

Eighty grams of zirconium oxide fine particles (product name: "EP-7") produced by Daiichi Kigenso Kagaku Kogyo Co., Ltd. ($ZrO_2$+$HfO_2$ purity: 99.50% or more, mean particle diameter: 2.1 μm, specific surface area: 7.1 $m^2$/g) were used as aerosol raw material P. The nozzle 18 used was a slit nozzle having a slit length of 30 mm and a slit width of 0.3 mm.

The aerosol raw material P was placed in an alumina tray and heated under air at 500° C. for 1 hour for degassing. Then, it was placed in an aerosol-generating container 2, and the aerosol-generating container 2 and a deposition chamber 3 were vacuum-evacuated to 10 Pa or less by an exhaust system 4. The aerosol-generating container 2 was kept at 150° C. with a mantle heater during deposition for acceleration of degassing.

After termination of the vacuum evacuation of the aerosol-generating container 2, $N_2$ gas (carrier gas) was introduced through a gas-supplying system 5 into the aerosol-generating container 2 at a flow rate of 12 L/min. The pressure of the aerosol-generating container 2 was approximately 35 kPa, the pressure of the deposition chamber 3 was 490 Pa, and the differential pressure between the aerosol-generating container 2 and the deposition chamber 3 was 35 kPa. The aerosol raw material P in the aerosol-generating container 2 was converted to aerosol, which was ejected through a transfer pipe 6 out of the nozzle 18, to be sprayed onto a substrate (glass slide) S.

A stage 7 carrying the substrate S thereon was driven for a distance of 15 mm at a rate of 1 mm/s by a stage-driving mechanism 8, the driving direction of the stage 7 was repeatedly reversed, and the stage 7 was caused to reciprocate. The reciprocation number was set to 25, and thus, the lamination number was set to 50 (passes). It took 13 minutes for film formation. The deposition film formed was less adhesive, leading to film separation and prohibiting formation of a dense film.

As described in Examples (3-1) to (3-7) and Comparative Examples (3-1) to (3-5) above, there was formed a zirconia thin film that is dense and favorably adhesive to the substrate by an aerosol gas deposition method using zirconia fine particles satisfying the conditions of a mean particle diameter of 2 μm or more and 4 μm or less, in particular, 2.2 μm or more and 3.5 μm or less and a specific surface area of 4 $m^2/g$ or more and 7 $m^2/g$ or less as the aerosol raw material. Alternatively when zirconia fine particles not satisfying the conditions are used as the aerosol raw material, there was not formed a zirconia thin film.

The present invention is not limited to the embodiments described above and can be modified within the scope of the gist of the present invention.

Description of Symbols

S substrate
1 aerosol gas deposition apparatus
2 aerosol-generating container
3 deposition chamber
4 exhaust system
5 gas-supplying system
6 transfer pipe
7 stage
8 stage-driving mechanism
9 vacuum pipe
10 first valve
11 second valve
12 vacuum pump
13 gas pipe
14 gas source
15 third valve
16 gas flowmeter
17 gas-blowout unit
18 nozzle

The invention claimed is:

1. A method for forming a zirconia film, comprising:
placing zirconia fine particles having a mean particle diameter of 0.7 μm or more and 11 μm or less and a specific surface area of 1 $m^2/g$ or more and 7 $m^2/g$ or less in a closed container;
generating an aerosol of the zirconia fine particles by introduction of a gas into the closed container;
conveying the aerosol through a transfer pipe connected to the closed container into a deposition chamber kept at a pressure lower than that of the closed container; and
depositing the zirconia fine particles on a substrate placed in the deposition chamber.

2. The method for forming a zirconia film according to claim 1, wherein the zirconia fine particles are yttria-containing zirconia fine particles having a mean particle diameter of 1 μm or more and 5 μm or less and a specific surface area of 1 $m^2/g$ or more and 4 $m^2/g$ or less.

3. The method for forming a zirconia film according to claim 2, wherein the mean particle diameter of the zirconia fine particles is 1.9 μm or more and 4.6 μm or less.

4. The method for forming a zirconia film according to claim 3, wherein the yttria is contained in the zirconia fine particles in an amount of 8 wt % or more and 14 wt % or less.

5. The method for forming a zirconia film according to claim 1, wherein the zirconia fine particles are zirconia fine particles prepared by a dry method, having a mean particle diameter of 0.7 μm or more and 11 μm or less and a specific surface area of 1 $m^2/g$ or more and 6.5 $m^2/g$ or less.

6. The method for forming a zirconia film according to claim 5, wherein the mean particle diameter of the zirconia fine particles is 0.7 μm or more and 10.2 μm or less.

7. The method for forming a zirconia film according to claim 1, wherein the zirconia fine particles are zirconia fine particles prepared by a wet method, having a mean particle diameter of 2 μm or more and 4 μm or less and a specific surface area of 4 $m^2/g$ or more and 7 $m^2/g$ or less.

8. The method for forming a zirconia film according to claim 7, wherein the mean particle diameter of the zirconia fine particles is 2.2 μm or more and 3.5 μm or less.

9. The method for forming a zirconia film according to claim 1, further comprising a step of degassing the zirconia fine particles before the step of placing the zirconia fine particles in the closed container.

10. The method for forming a zirconia film according to claim 1, wherein, in the step of generating the aerosol, the zirconia fine particles are agitated in the closed container and mixed in the gas, as the gas is introduced from a gas-blowout unit.

* * * * *